US006883474B2

(12) United States Patent
Bucknor

(10) Patent No.: US 6,883,474 B2
(45) Date of Patent: Apr. 26, 2005

(54) ELECTROHYDRAULIC ENGINE VALVE ACTUATOR ASSEMBLY

(75) Inventor: Norman Kenneth Bucknor, Troy, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/405,891

(22) Filed: Apr. 2, 2003

(65) Prior Publication Data

US 2004/0194740 A1 Oct. 7, 2004

(51) Int. Cl.[7] ..... F01L 9/02

(52) U.S. Cl. ..... 123/90.12; 123/90.11; 123/90.15; 251/58; 251/129.2; 91/368; 91/384

(58) Field of Search ..... 123/90.11, 90.12, 123/90.15, 90.39, 90.41; 251/58, 129.2; 74/519, 559; 91/368, 379, 384

(56) References Cited

U.S. PATENT DOCUMENTS

| | | | | | |
|---|---|---|---|---|---|
| 1,703,858 | A | | 3/1929 | Banner | |
| 2,917,026 | A | * | 12/1959 | Hall et al. | 91/359 |
| 3,157,166 | A | | 11/1964 | MacNeill | |
| 3,596,528 | A | | 8/1971 | Dittrich et al. | 74/230.17 F |
| 4,009,695 | A | | 3/1977 | Ule | |
| 4,044,652 | A | * | 8/1977 | Lewis et al. | 91/368 |
| 4,459,946 | A | | 7/1984 | Burandt | |
| 4,807,517 | A | * | 2/1989 | Daeschner | 91/384 |
| 5,373,818 | A | | 12/1994 | Unger | |
| 5,421,545 | A | * | 6/1995 | Schexnayder | 251/30.02 |
| 5,546,222 | A | | 8/1996 | Plaessmann et al. | 359/346 |
| 5,563,198 | A | | 10/1996 | Schilling | 524/272 |
| 5,572,961 | A | | 11/1996 | Schechter et al. | |
| 5,638,781 | A | | 6/1997 | Sturman | 123/90.12 |
| 5,881,689 | A | | 3/1999 | Hochholzer | |
| 6,112,711 | A | | 9/2000 | Shimizu et al. | |
| 6,263,842 | B1 | | 7/2001 | DeOjeda et al. | 123/90.12 |
| 6,374,784 | B1 | * | 4/2002 | Tischer et al. | 123/90.12 |
| 6,505,584 | B1 | | 1/2003 | Lou | |
| 6,688,267 | B1 | | 2/2004 | Raghavan | |
| 2003/0015155 | A1 | | 1/2003 | Turner et al. | |
| 2003/0172885 | A1 | | 9/2003 | Gaessler et al. | |

* cited by examiner

*Primary Examiner*—Edward K. Look
*Assistant Examiner*—Kyle M. Riddle
(74) *Attorney, Agent, or Firm*—Kathryn A. Marra

(57) ABSTRACT

An electrohydraulic valve actuator assembly for an engine includes a movable engine valve, a movable spool valve, and a driving channel interconnecting the spool valve and the engine valve. The electrohydraulic valve actuator assembly includes an actuator operatively cooperating with the spool valve to position the spool valve to prevent and allow fluid flow in and out of the driving channel to position the engine valve. The electrohydraulic valve actuator assembly further includes a mechanical feedback interconnecting the engine valve and the spool valve to control the position of the spool valve.

20 Claims, 4 Drawing Sheets

ELECTROHYDRAULIC ENGINE VALVE ACTUATOR ASSEMBLY

TECHNICAL FIELD

The present invention relates generally to intake or exhaust valve actuators for engines and, more particularly, to an electrohydraulic valve actuator assembly for an internal combustion engine.

BACKGROUND OF THE INVENTION

It is known to provide a valve train or valve actuator assembly for an engine such as an internal combustion engine of a vehicle such as a motor vehicle. Typically, the valve train includes one or more valves, a cam shaft having one or more cams, and a tappet contacting each cam and valve. Typically, engine valve operation is accomplished via the engine-driven camshaft. However, this type of valve actuation introduces constraints on valve operation that preclude optimal valve opening and closing schedules, compromising engine performance, fuel economy, and emissions.

It is also known to provide a camless valve train for an internal combustion engine. An example of such a camless valve train is disclosed in the prior art. For example, a camless intake/exhaust valve for an internal combustion engine is controlled by a solenoid actuated fluid control valve. The control valve has a pair of solenoids that move a spool. The solenoids are digitally latched by short digital pulses provided by a microcontroller.

One class of these camless valve trains uses hydraulic fluid power to control engine valve operation. Precise engine valve positioning and seating control requires high pressure flow control. However, acceptable system performance has been achieved only with a powerful actuator driving a spool valve or an expensive two-stage servo valve.

As a result, it is desirable to provide a valve actuator assembly for an engine that achieves acceptable performance using a valve and actuator of more modest performance capability. It is also desirable to provide a valve actuator assembly for an engine that reduces cost and power consumption. It is further desirable to provide a valve actuator assembly that provides feedback to operate a valve for flow control. Therefore, there is a need in the art to provide an electrohydraulic valve actuator assembly for an engine that meets these desires.

SUMMARY OF THE INVENTION

It is, therefore, one object of the present invention to provide an electrohydraulic valve actuator assembly for an engine.

It is another object of the present invention to provide an electrohydraulic valve actuator assembly for an engine that has mechanical position feedback.

To achieve the foregoing objects, the present invention is an electrohydraulic valve actuator assembly for an engine. The electrohydraulic valve actuator assembly includes a movable engine valve, a movable spool valve, and a driving channel interconnecting the spool valve and the engine valve. The electrohydraulic valve actuator assembly also includes an actuator operatively cooperating with the spool valve to move the spool valve to prevent and allow fluid flow in and out of the driving channel to position the engine valve. The electrohydraulic valve actuator assembly further includes a mechanical feedback interconnecting the engine valve and the spool valve to control the position of the spool valve.

One advantage of the present invention is that an electrohydraulic valve actuator assembly is provided for an engine that has mechanical position feedback and stroke amplification. Another advantage of the present invention is that the electrohydraulic valve actuator assembly is an enabler for improved engine performance, improved engine fuel economy by lowering fuel consumption, improved engine emissions by lowering emissions, and optimal engine power output. Yet another advantage of the present invention is that the electrohydraulic valve actuator assembly achieves system energy consumption and controllability (e.g., repeatability, seating velocity) targets at a reasonable cost. Still another advantage of the present invention is that the electrohydraulic valve actuator assembly uses mechanical feedback to operate a valve for self-regulation flow control. A further advantage of the present invention is that the electrohydraulic valve actuator assembly uses a simple spool valve and control actuator of more modest performance capability. Yet a further advantage of the present invention is that the electrohydraulic valve actuator assembly reduces cost and power consumption by using a low-cost actuator. Still a further advantage of the present invention is that the electrohydraulic valve actuator assembly has simplified soft-seating control.

Other objects, features, and advantages of the present invention will be readily appreciated, as the same becomes better understood, after reading the subsequent description taken in conjunction with the accompanying drawings.

DESCRIPTION OF THE PREFERRED EMBODIMENT

Figure 1:
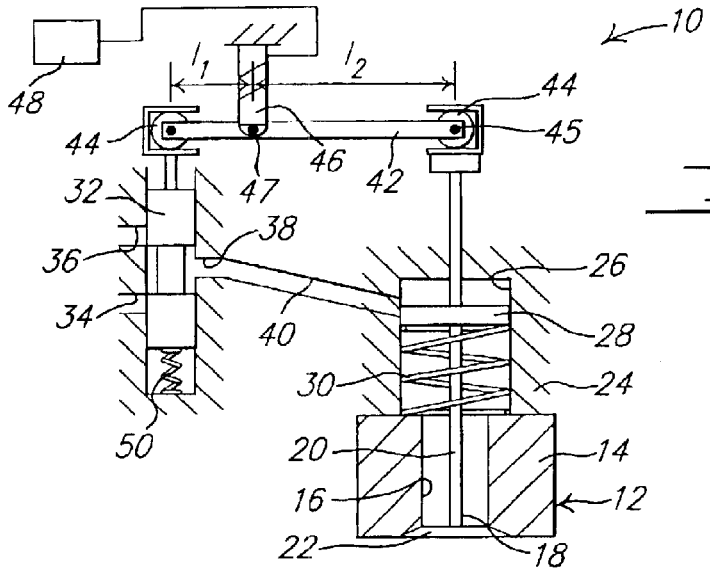
FIG. 1 is a diagrammatic view of an electrohydraulic valve actuator assembly, according to the present invention, illustrated in operational relationship with an engine in a closed position.
Figure 2:
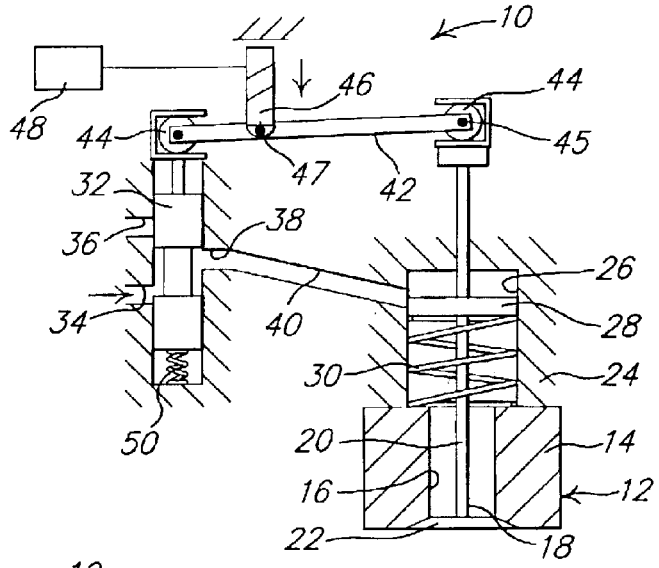
FIG. 2 is a view similar to FIG. 1 illustrating the electrohydraulic valve actuator assembly with actuator motion starting.

Referring to the drawings and in particular FIG. 1, one embodiment of an electrohydraulic valve actuator assembly 10, according to the present invention, is shown for an engine, generally indicated at 12, of a vehicle (not shown). The engine 12 is of an internal combustion type. The engine 12 includes an engine block 14 having at least one opening 16 therein in communication with at least one internal combustion chamber (not shown). The engine 12 also includes a movable engine valve 18 for each opening 16. The engine valve 18 has a valve stem 20 and a valve head 22 at one end of the valve stem 20. The engine valve 18 is movable to open and close its respective opening 16 between an open position as illustrated in FIGS. 3 through 6 and a closed position as illustrated in FIGS. 1 and 2. It should be appreciated that the engine valve 18 may be either an intake or exhaust valve. It should also be appreciated that the electrohydraulic valve actuator assembly 10 is a camless valve train for the engine 12. It should further be appreciated that, except for the electrohydraulic valve actuator assembly 10, the engine 12 is conventional and known in the art.

The electrohydraulic valve actuator assembly 10 includes a valve housing 24 disposed adjacent the engine block 14. The valve housing 24 has a main or control fluid chamber 26 therein. The valve actuator assembly 10 also includes a piston 28 connected to or in contact with valve stem 20 opposite the valve head 22. The piston 28 is disposed in the fluid chamber 26 of the valve housing 24. The electrohydraulic valve actuator assembly 10 includes an engine or return valve spring 30 disposed about the valve stem 20 and contacting the engine block 14 to bias the engine valve 18 toward the closed position of FIGS. 1 and 2. It should be appreciated that the valve head 22 closes the opening 16 when the engine valve 18 is in the closed position.

The electrohydraulic valve actuator assembly 10 also includes a spool valve 32 fluidly connected to the fluid chamber 26 of the valve housing 24. The spool valve 32 is of a three-position three-way type. The spool valve 32 has a high pressure port 34 and a low pressure port 36. The spool valve 32 also has a fluid chamber port 38 fluidly connected by a driving channel 40 to the fluid chamber 26. It should be appreciated that the spool valve 32 controls fluid flow with the fluid chamber 26.

The electrohydraulic valve actuator assembly 10 includes a mechanical feedback interconnecting the spool valve 32 and the engine valve 18 to control the position of the spool valve 32. In the embodiment illustrated, the mechanical feedback is a rigid control lever 42 interconnecting one end of the spool valve 32 and one end of the valve stem 20 opposite the valve head 22. The electrohydraulic valve actuator assembly 10 also includes a roller 44 connected to one end of the control lever 42 at an attachment point 45 adjacent the end of the valve stem 20 of the engine valve 18 and connected to the other end of the control lever 42 adjacent to the end of the spool valve 32. The rollers 44 are slotted to connect the spool valve 32 and engine valve 18 to the control lever 42 to provide the necessary degrees of relative freedom therebetween. It should be appreciated that the spool valve 32, fluid chamber 26, and channel 40 are located in the valve housing 24.

The electrohydraulic valve actuator assembly 10 further includes an actuator 46 connected to the control lever 42 at a connection point 47. The actuator 46 is of an electromechanical type electrically connected to a source of electrical power such as a controller 48. The connection point 47 has a distance 11 from the spool valve 32, which is less than a distance 12 from the engine valve 18. The electrohydraulic valve actuator assembly 10 further includes a spool or return valve spring 50 at one end of the spool valve 32 to bias the spool valve 32 toward the actuator 46. It should be appreciated that the controller 48 energizes and de-energizes the actuator 46.

In operation of the electrohydraulic valve actuator assembly 10, the engine valve 18 is shown in a closed position as illustrated in FIG. 1. At the closed position of the engine valve 18, the actuator 46 is de-energized by the controller 48 so that the spool valve spring 50 pushes the spool valve 32 upward. The spool valve 32 is in a "null flow" position such that the spool valve 32 blocks the high pressure port 34 from the fluid chamber port 38, which connects to the fluid chamber 26. The low pressure port 36 may be partially unblocked (underlapped spool) in this position to relieve fluid pressure in the fluid chamber 26. The engine valve spring 30 keeps the engine valve 18 closed with the valve head 22 closing the opening 16. It should be appreciated that, in this position, there is no flow to the fluid chamber 26 and any fluid trapped within the fluid chamber 26 is at vent or low pressure.

To open the engine valve 18, the controller 48 energizes the actuator 46 and causes the actuator 46 to extend, forcing the control lever 42 downward as illustrated in FIG. 2. Because the engine valve spring 30 holds the engine valve 18 in place, the control lever 42 initially pivots about the attachment point 45, between the control lever 42 and the engine valve 18. The control lever 42 pushes the spool valve 32 downward to open the high pressure port 34, causing high pressure fluid to flow into the fluid chamber 26 while blocking the low pressure port 36. The pressure rise in the fluid chamber 26 causes the engine valve 18 to open against the force from the engine valve spring 30.

Figure 3:
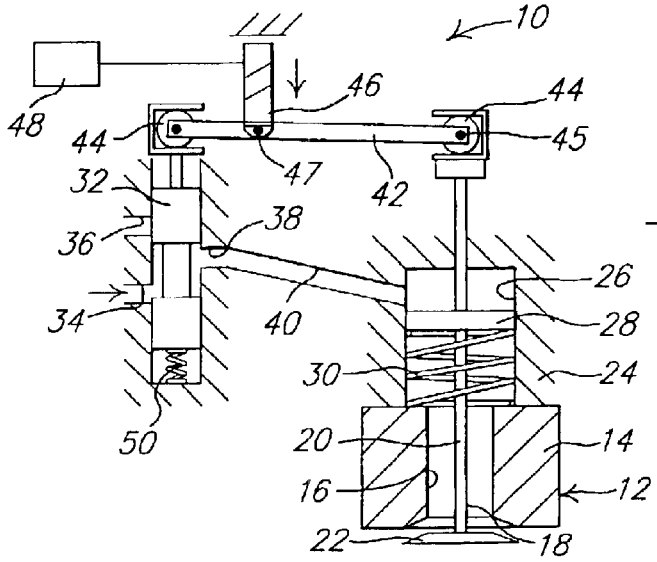
FIG. 3 is a view similar to FIG. 1 illustrating the electrohydraulic valve actuator assembly in an engine valve opening position.
Figure 4:
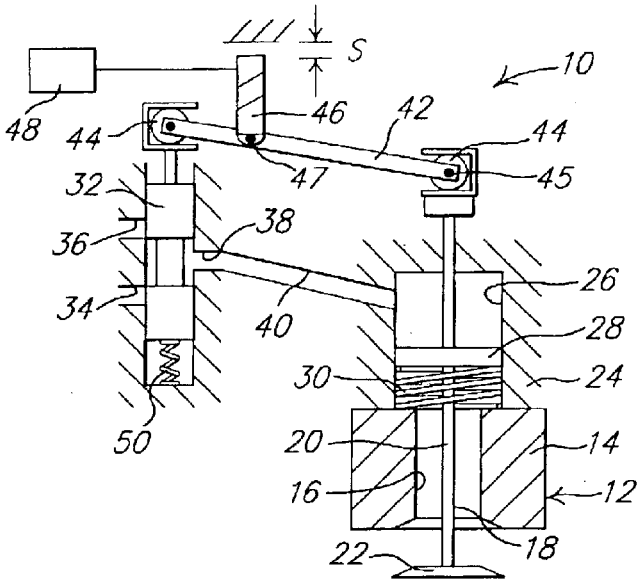
FIG. 4 is a view similar to FIG. 1 illustrating the electrohydraulic valve actuator assembly with an engine valve at a commanded lift position.

As the engine valve 18 moves downward, the control lever 42 now pivots about the connection point 47, tending to move the spool valve 32 toward the "null flow" position of FIG. 3. Once the actuator 46 reaches its commanded lift position ($[l_2/l_1+1]\times s$), the motion of the engine valve 18 will stop when the control lever 42 rotates to move the spool valve 32 to block both the high pressure port 34 and the low pressure port 36 as illustrated in FIG. 4. The motion of the control lever 42 serves as a mechanical feedback loop between the motions of the spool valve 32 and the engine valve 18, regulating the flow into the fluid chamber 26 such that the motion of the engine valve 18 is an amplification of the stroke of the actuator 46 as illustrated in FIG. 4. It should be appreciated that, ideally, the velocity of the actuator 46 is just sufficient to cause the motion of the engine valve 18 to track the motion of the actuator 46 with a slight lag, preventing the engine valve 18 from overshooting the desired or predetermined lift position. It should also be appreciated that, if an overshoot occurs, the motion of the control lever 42 will cause the spool valve 32 to move past the "null flow" position to the vent position, causing some fluid to exhaust from the fluid chamber 26 and the engine valve 18 will move upward, moving the spool valve 32 toward the "null flow" position. It should further be appreciated that this oscillatory motion is eventually damped out by internal friction and leakage. It should still further be appreciated that, at the "null flow" position, the fluid in the fluid chamber 26 is hydraulically locked and the engine valve 18 stays at the commanded lift position as illustrated in FIG. 4.

Figure 5:
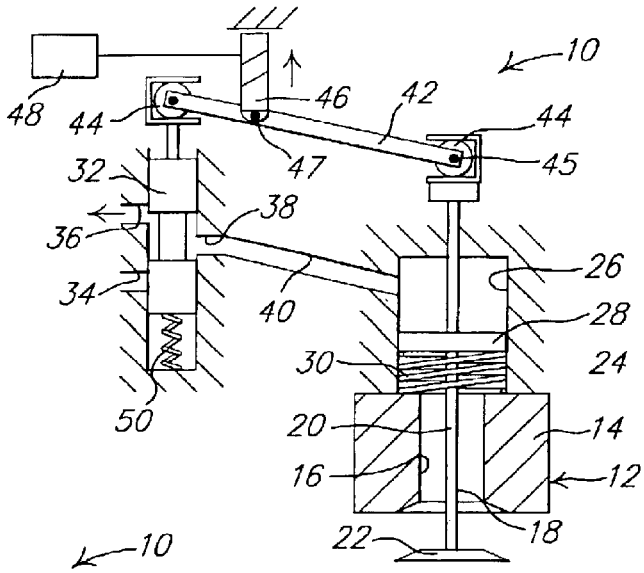
FIG. 5 is a view similar to FIG. 1 illustrating the electrohydraulic valve actuator assembly with actuator retraction beginning.
Figure 6:
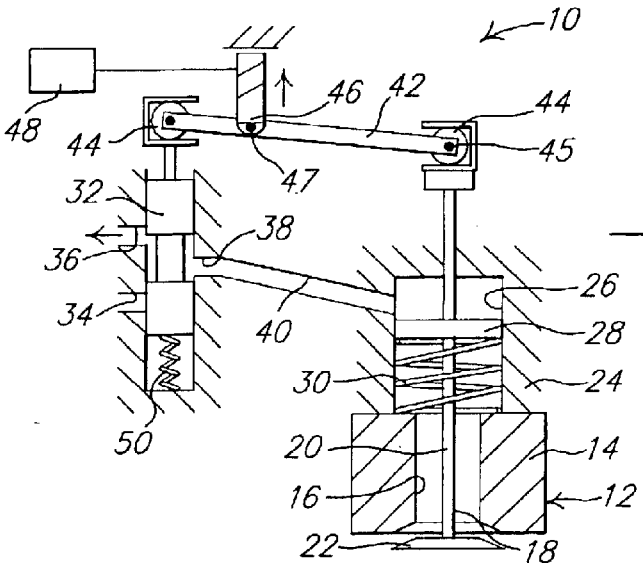
FIG. 6 is a view similar to FIG. 1 illustrating the electrohydraulic valve actuator assembly in an engine valve closing position.
Figure 7:
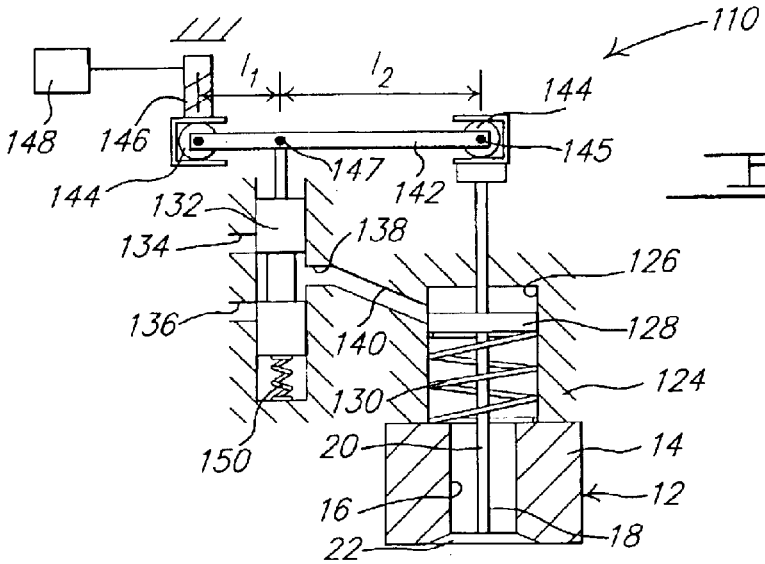
FIG. 7 is a diagrammatic view of another embodiment, according to the present invention, of the electrohydraulic valve assembly of FIG. 1 in an engine valve closed position.
Figure 8:
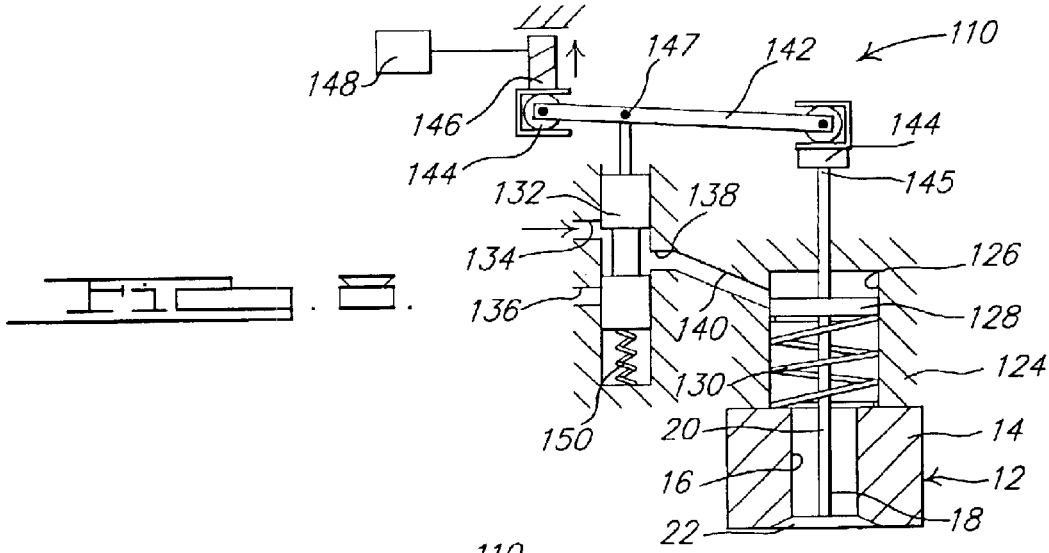
FIG. 8 is a view similar to FIG. 9 illustrating the electrohydraulic valve actuator assembly with actuator motion starting.
Figure 9:
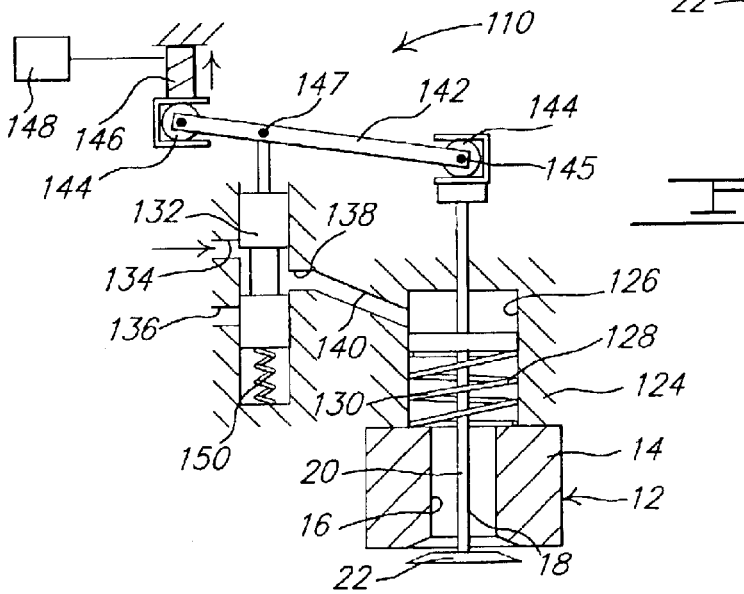
FIG. 9 is a view similar to FIG. 1 illustrating the electrohydraulic valve actuator assembly in an engine valve opening position.
Figure 10:
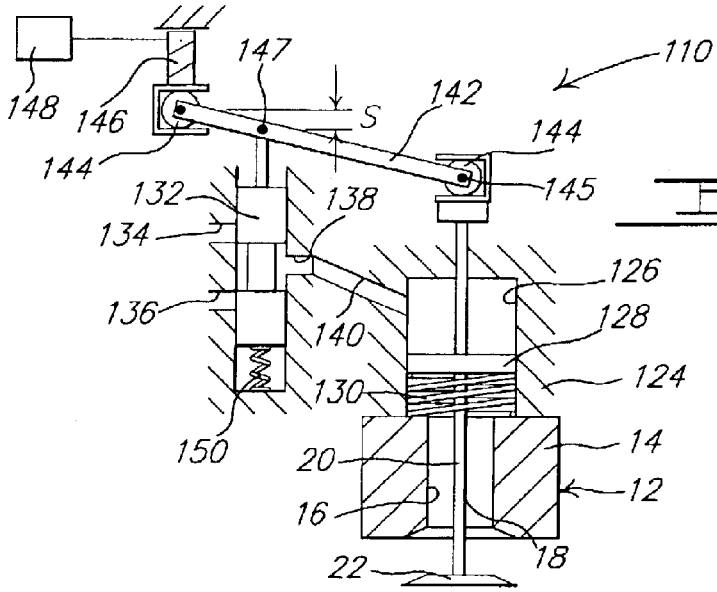
FIG. 10 is a view similar to FIG. 1 illustrating the electrohydraulic valve actuator assembly with an engine valve at a commanded lift position.
Figure 11:
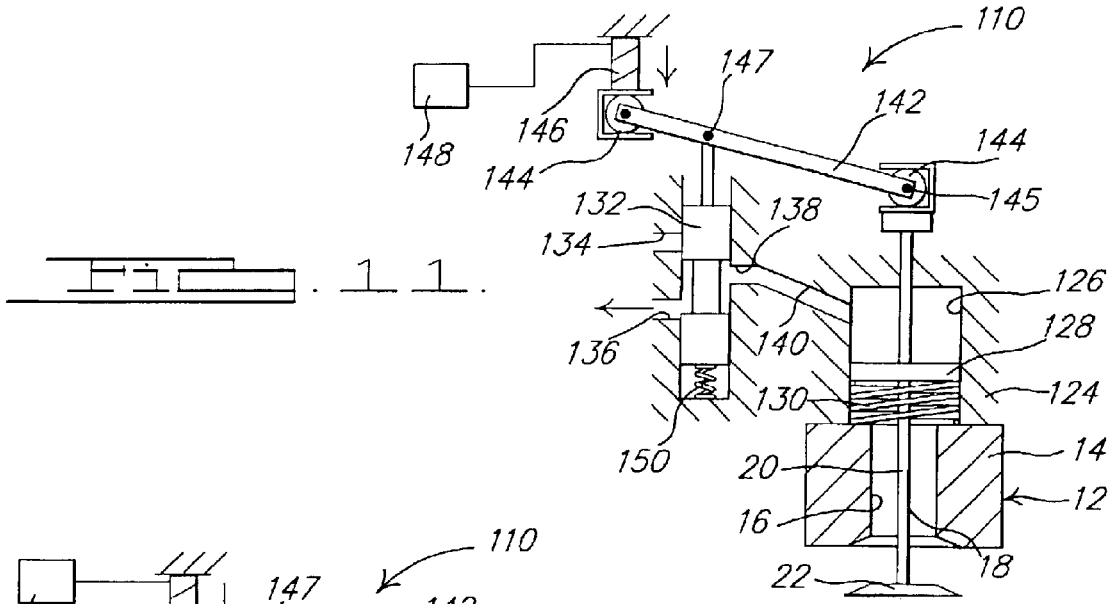
FIG. 11 is a view similar to FIG. 1 illustrating the electrohydraulic valve actuator assembly with actuator retraction beginning.
Figure 12:
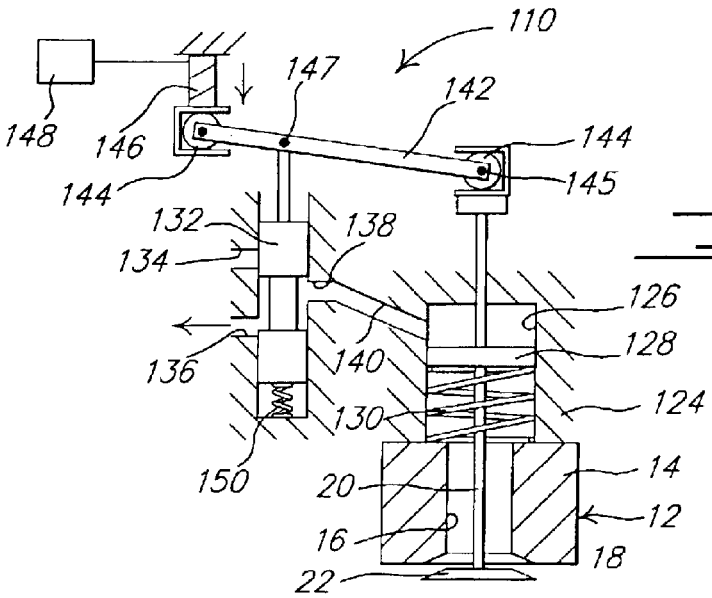
FIG. 12 is a view similar to FIG. 1 illustrating the electrohydraulic valve actuator assembly in an engine valve closing position.

To close the engine valve 18, the controller 48 de-energizes the actuator 46. The actuator 46 retracts to its initial rest position, causing the spool valve 32 to move to the vent position as illustrated in FIG. 5. Exhausting fluid from the fluid chamber 26 causes the engine valve 18 to retract toward the closed position, with the control lever 42 pivoting about the connection point 47, restricting the flow rate out of the fluid chamber 26. It should be appreciated that engine-valve seating control is simplified since it is sufficient to control the deceleration of the actuator 46 as it returns to the rest or closed position. It should also be appreciated that engine-valve seating velocity is regulated by the pivoting action of the control lever 42, which tends to close the low pressure port 36, reducing the flow area as the engine valve 18 nears the closed position as illustrated in FIG. 6. It should further be appreciated that the flow restriction creates a pressure buildup in the fluid chamber 26, which acts to brake the motion of the engine valve 18.

Referring to FIGS. 7 through 12, another embodiment, according to the present invention, of the electrohydraulic valve actuator assembly 10 is shown. Like parts of the electrohydraulic valve actuator assembly 10 have like reference numerals increased by one hundred (100). In this embodiment, the electrohydraulic valve actuator assembly 110 includes the valve housing 124, fluid chamber 126, piston 128, engine valve spring 130, spool valve 132, high pressure port 134, low pressure port 136, fluid chamber port 138, driving channel 140, control lever 142, rollers 144, actuator 146, controller 148, and spool valve spring 150. The electrohydraulic valve actuator assembly 110 also includes one of the rollers 144 connected to the control lever 142 at one end at an attachment point 145 adjacent to the end of the valve stem 20 of the engine valve 18 and the other roller 144 connected to the other end of the control lever 142. The electrohydraulic valve actuator assembly 110 includes the actuator 146 connected to the other end of the control lever 142 adjacent to the roller 144 opposite the attachment point 145. The electrohydraulic valve actuator assembly 110 further includes the spool valve 132 connected to the control lever 142 at a connection point 147. The connection point 147 has a distance $l_1$ from the actuator 146, which is less than a distance $l_2$ from the engine valve 18. The operation of the electrohydraulic valve actuator assembly 110 is similar to the electrohydraulic valve actuator assembly 10.

The present invention has been described in an illustrative manner. It is to be understood that the terminology, which has been used, is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. An electrohydraulic valve actuator assembly for an engine comprising:

a movable engine valve;

a movable spool valve;

a single driving fluid channel interconnecting said spool valve and said engine valve;

an actuator operatively cooperating with said spool valve to move said spool valve to prevent and allow fluid flow in and out of said driving fluid channel to position said engine valve;

a spool valve spring disposed at one end of said spool valve to bias said spool valve toward said actuator; and a mechanical feedback interconnecting said engine valve and said spool valve to control the position of said spool valve.

2. An electrohydraulic valve actuator assembly as set forth in claim 1 including a valve housing.

3. An electrohydraulic valve actuator assembly as set forth in claim 2 wherein said valve housing has a fluid chamber fluidly communicating with said driving fluid channel.

4. An electrohydraulic valve actuator assembly as set forth in claim 3 including a piston operatively cooperating with said engine valve and being disposed in said valve housing and having said fluid chamber on one side thereof.

5. An electrohydraulic valve actuator assembly as set forth in claim 1 wherein said actuator is connected to said mechanical feedback at a connection point spaced between ends thereof.

6. An electrohydraulic valve actuator assembly as set forth in claim 5 wherein said connection point is located at a distance from said spool valve which is less than a distance from said engine valve.

7. An electrohydraulic valve actuator assembly as set forth in claim 1 wherein said actuator is of a linear type to generate linear motion.

8. An electrohydraulic valve actuator assembly as set forth in claim 1 including a controller electrically connected to said actuator to energize and de-energize said actuator.

9. An electrohydraulic valve actuator assembly for an engine comprising:

a movable engine valve;

a movable spool valve;

a driving channel interconnecting said spool valve and said engine valve;

an actuator operatively cooperating with said spool valve to move said spool valve to prevent and allow fluid flow in and out of said driving channel to position said engine valve;

a mechanical feedback interconnecting said engine valve and said spool valve to control the position of said spool valve; and wherein said spool valve is connected to said mechanical feedback at a connection point spaced between ends thereof.

10. An electrohydraulic valve actuator assembly as set forth in claim 9 wherein said connection point is located at a distance from said actuator which is less than a distance from said engine valve.

11. An electrohydraulic valve actuator assembly for an engine comprising:

a movable engine valve;

a movable spool valve;

a driving channel interconnecting said spool valve and said engine valve;

an actuator operatively cooperating with said spool valve to move said spool valve to prevent and allow fluid flow in and out of said driving channel to position said engine valve;

a mechanical feedback interconnecting said engine valve and said spool valve to control the position of said spool valve; and a spool valve spring disposed at one end of said spool valve to bias said spool valve toward said actuator.

12. An electrohydraulic valve actuator assembly comprising:

a movable engine valve;

a movable spool valve;

a valve housing having a fluid chamber therein;

a piston operatively cooperating with said engine valve and being disposed in said valve housing and having said fluid chamber on one side thereof;

a single driving fluid channel interconnecting said spool valve and said engine valve, said driving fluid channel being connected to said fluid chamber;

an actuator operatively cooperating with said spool valve to move said spool valve to prevent and allow fluid flow in and out of said driving fluid channel to position said engine valve;

a spool valve spring disposed at one end of said spool valve to bias said spool valve toward said actuator; and a control lever interconnecting said engine valve and said spool valve to control the position of said spool valve.

13. An electrohydraulic valve actuator assembly as set forth in claim 12 wherein said actuator is connected to said control lever at a connection point spaced between ends of said control lever.

14. An electrohydraulic valve actuator assembly as set forth in claim 13 wherein said connection point is located at a distance from said spool valve which is less than a distance from said engine valve.

15. An electrohydraulic valve actuator assembly as set forth in claim 12 wherein said actuator is of a linear type to generate linear motion.

16. An electrohydraulic valve actuator assembly as set forth in claim 15 including a controller electrically connected to said actuator to energize and de-energize said actuator.

17. An electrohydraulic valve actuator assembly comprising:

a movable engine valve;

a movable spool valve;

a valve housing having a fluid chamber therein;

a piston operatively cooperating with said engine valve and being disposed in said valve housing and having said fluid chamber on one side thereof;

a driving channel interconnecting said spool valve and said fluid chamber;

an actuator operatively cooperating with said spool valve to move said spool valve to prevent and allow fluid flow in and out of said driving channel to position said engine valve;

a control lever interconnecting said engine valve and said spool valve to control the position of said spool valve; and wherein said spool valve is connected to said control lever at a connection point spaced between ends of said control lever.

18. An electrohydraulic valve actuator assembly as set forth in claim 17 wherein said connection point is located at a distance from said actuator which is less than a distance from said engine valve.

19. An electrohydraulic valve actuator assembly comprising:

a movable engine valve;

a movable spool valve;

a valve housing having a fluid chamber therein;

a piston operatively cooperating with said engine valve and being disposed in said valve housing and having said fluid chamber on one side thereof;

a driving channel interconnecting said spool valve and said fluid chamber;

an actuator operatively cooperating with said spool valve to move said spool valve to prevent and allow fluid flow in and out of said driving channel to position said engine valve;

a control lever interconnecting said engine valve and said spool valve to control the position of said spool valve; and a spool valve spring disposed at one end of said spool valve to bias said spool valve toward said actuator.

20. A method of operating a valve actuator assembly for a vehicle comprising:

providing a movable engine valve;

providing a movable spool valve;

providing a spool valve spring at one end of the spool valve to bias the spool valve;

providing a control lever interconnecting the engine valve and the spool valve;

actuating an actuator operatively cooperating with the control lever and supplying a single driving fluid channel interconnecting the spool valve and the engine valve with fluid flow to move open the engine valve; and controlling motion of the spool valve via the control lever.

* * * * *